US005595507A

United States Patent [19]

Braun et al.

[11] Patent Number: 5,595,507

[45] Date of Patent: Jan. 21, 1997

[54] MOUNTING BRACKET AND GROUND BAR FOR A CONNECTOR BLOCK

[75] Inventors: Rudy R. Braun, Oakland; Antonio A. Figueiredo, Belleville; Adam S. Kane, Morristown; Jeremia P. Starace, Nutley, all of N.J.

[73] Assignee: Lucent Technologies Inc., Murray Hill, N.J.

[21] Appl. No.: 442,900

[22] Filed: May 17, 1995

[51] Int. Cl.[6] ..... H01R 9/26

[52] U.S. Cl. ..... 439/716; 439/94

[58] Field of Search ..... 439/94, 532, 540.1, 439/716

[56] References Cited

U.S. PATENT DOCUMENTS 3,798,587 3/1974 Ellis, Jr. et al. .
4,171,857 10/1979 Forberg et al. .
4,283,103 8/1981 Forberg et al. .

FOREIGN PATENT DOCUMENTS 503704 9/1992 European Pat. Off. ..... 439/716
2017428 3/1979 United Kingdom .

*Primary Examiner*—Gary F. Paumen

[57] ABSTRACT

A hinged mounting bracket and attachable ground bar used in conjunction with a telephone wire termination block. The mounting bracket is adapted to accept modular connectors in order to form any size connecting block. The hinged bracket consists of two pieces, a bracket base and a front flap which receives the modular connectors. In a preferred embodiment, the front flap is coupled to the base by a hinge which enables the bracket to rotate open so that rear terminals of the modular connectors may be easily accessed. The ground bar is attachable to the front or rear of the mounting bracket in order to provide a ground for gas tube circuit protectors that may be inserted into the modular connectors. The ability to secure the ground bar to the mounting bracket in a variety of orientations provides additional flexibility for all types of wiring schemes. In a preferred embodiment of the invention, the ground bar couples to support posts on the mounting bracket utilizing a force fit insertion. A tab on the ground bar creates a bias against the support posts to retain the ground bar in a fixed position. Individual circuit protection modules are adapted to be received on the ground bar which establishes a positive seat connection.

22 Claims, 3 Drawing Sheets

MOUNTING BRACKET AND GROUND BAR FOR A CONNECTOR BLOCK

RELATED APPLICATIONS

The present patent application is related to U.S. patent application Ser. No. 08/442,901, entitled Mounting Bracket For Connectors, having a filing date of May 17, 1995, that application having a common assignee and one or more common inventors and being incorporated herein by reference.

FIELD OF THE INVENTION

The present invention relates to a mounting bracket for a telephone circuit connector block, and more particularly to a combination ground bar and mounting bracket wherein the ground bar is adapted to attach to the bracket in any one of a number of orientations.

BACKGROUND OF THE INVENTION

Individual pairs of telephone circuit wires are frequently terminated in telephone company central offices, distribution cabinets and customer premise locations, for example, utilizing multi-terminal connector blocks. Once terminated, these telephone circuit wires, usually comprised of cables containing narrow gauge insulated copper conductors, are grouped and then rerouted for appropriate distribution of the calls which they carry. Single connector blocks normally accommodate anywhere from 60 to 100 pairs of densely packed terminations, wherein multiple connector blocks are frequently contained in close proximity at a single location, e.g., one wall of a telephone switching room. Efficient utilization of mounting space is thus required since space within utility locations is traditionally at a premium.

Besides the incoming circuit terminations, the connector blocks are also utilized for making cross-connections between individual circuits on the connector blocks, as well as for mounting of current and voltage limiting circuit protection used to prevent damage caused by lightning and other external forces. For the most part, the terminations and cross-connections are made only at a front facing side of any connector block, this is because the front area is the only area which is easily accessible. In addition, the circuit protection is also generally included at the front of the block, wherein grounding connections to establish a conduction path from the circuit protection to the mounting frame are required and accomplished, for example, by way of a ground bus. The many connections on the front face of a connector block make for a congested wiring arrangement. Moreover, if testing needs to be performed at the connecting block, the associated circuit protection and grounding arrangement will, at the very least, need to be removed. This action leaves the circuits under test, and most likely many of the other circuits in the general vicinity, without any surge protection while testing is underway.

It is therefore an object of the present invention to provide a mounting bracket with improved grounding capabilities, such that circuit protection may be flexibly positioned at alternate areas of the bracket in order that the circuit protection need not always be removed when a circuit is under test.

SUMMARY OF THE INVENTION

The present invention is a hinged mounting bracket and attachable ground bar used in conjunction with a telephone wire connecting block for terminating telephone circuit wires. The mounting bracket is adapted to accept modular connectors in order to form any size connecting block. In one preferred embodiment, the bracket is hinged and consists of two pieces, a bracket base and a front flap which receives the modular connectors. The from flap is coupled to the base by a hinge which enables the bracket to rotate open so that rear terminals of the modular connectors may be easily accessed. In another preferred embodiment, the front flap is completely removable from the base and is coupled thereto by means of a snap-fit connection. The ground bar is attachable to the front or rear of the mounting bracket in order to provide a ground for gas tube circuit protectors that may be inserted into the modular connectors. The ability to secure the ground bar to the mounting bracket in a variety of orientations provides additional flexibility for all types of wiring schemes in that circuit protection may be included on either the front or back side of the connecting block. This additional flexibility combined with a continuous utilization of the rear side of the connecting block allows for less congested and better organized wring arrangements.

In a preferred embodiment of the invention, the ground bar couples to support posts on the mounting bracket utilizing a force fit insertion. A tab on the ground bar is biased against the support posts to retain the ground bar in a fixed position. Individual circuit protection modules are adapted to be received on the ground bar which establishes a positive seat connection.

BRIEF DESCRIPTION OF THE FIGURES

For a better understanding of the present invention, reference may be had to the following description of exemplary embodiments thereof, considered in conjunction with the accompanying drawings, in which.

DETAILED DESCRIPTION OF THE DRAWINGS

Figure 1:
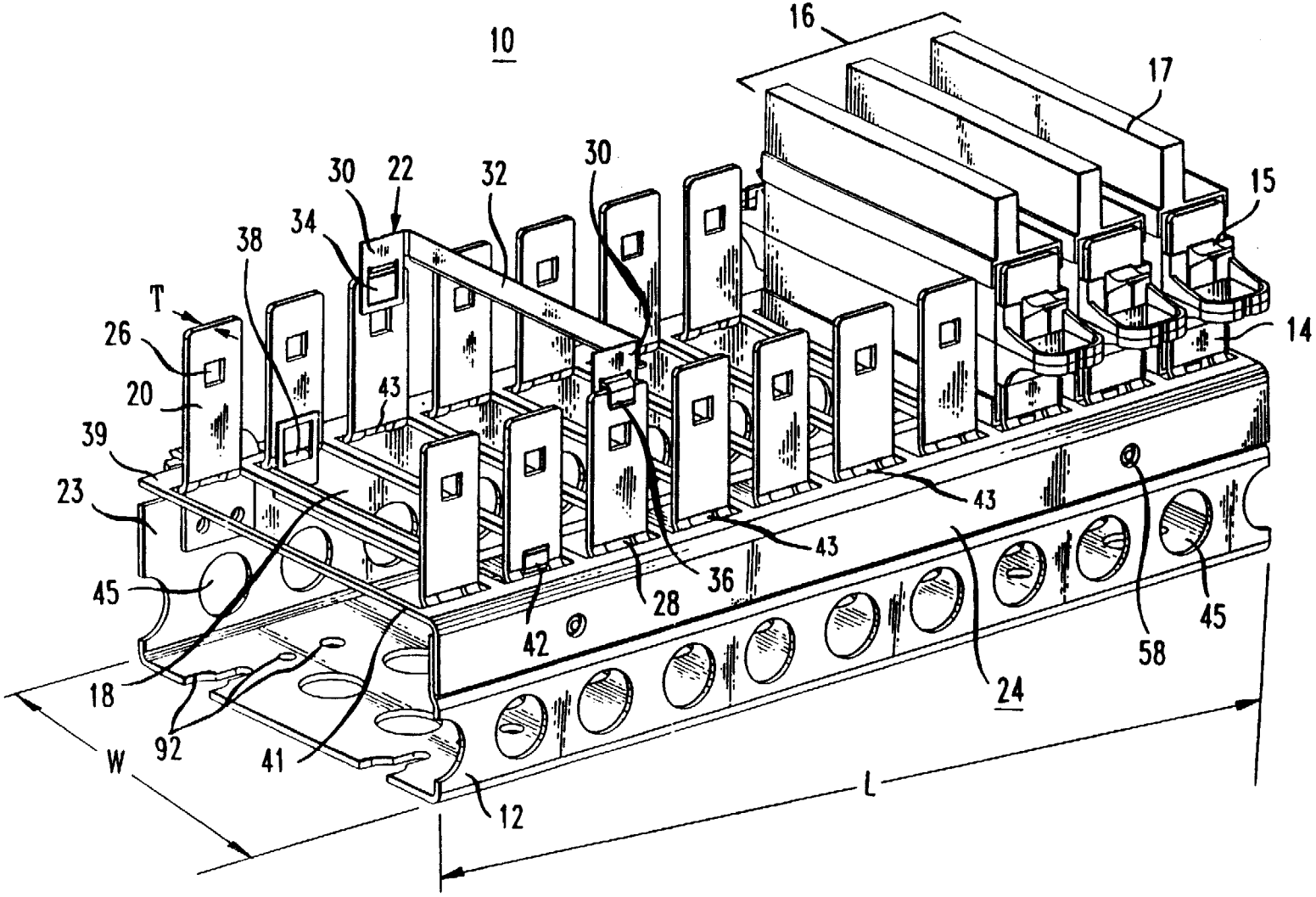
FIG. 1 shows a front perspective view of one preferred embodiment of the present invention mounting bracket ground bar combination.

The present invention is a combination mounting bracket and ground bar for use with connecting blocks that terminate telephone circuit wires. Referring to FIG. 1, there is shown one preferred embodiment for the present invention mounting bracket and ground bar combination 10. As shown, the mounting bracket 12 is partially loaded with a plurality of connector modules 14 that are inserted into the bracket to make up a connector block 16. The connector modules 14 as shown include terminal caps 17 for covering exposed terminals of the connector modules. The connector modules are insertable into receptacle openings 18 within the front portion of the mounting bracket 12 and are supported by pairs of posts 20 on either side of the bracket. The present invention ground bar 22 is mountable to the support posts 20 as will be explained.

The support posts 20 extend vertically upward and are oriented parallel to sides 23, 24 of the mounting bracket. In a preferred embodiment of the invention, the support posts 20 are generally thin rectangular members, wherein each of the support posts includes a rectangular opening 26 disposed centrally within the post. The openings 26 are adapted to receive a fastening tab 15 on the connector module 14 for securing the connector in place within the bracket 12.

FIG. 1 also shows one preferred embodiment of the present invention ground bar 22. The ground bar 22 is adapted to couple to the posts 20 of the mounting bracket in a variety of orientations. As shown in the third mounting slot 28 of the bracket 12, the ground bar 22 is coupled to the bracket proximate the top portion of the support posts 20. The ground bar 22 is essentially a unitary structure comprised of three sections oriented at right angles to one another. The three sections include two connecting plates 30 which are identical mirror images of one another and a bus bar 32 in between connected at one end of each of the connecting plates. The connecting plates 30 are essentially thin rectangular members having a singular cutout 34 stamped therein. A tab 36 created from the cutout 34 remains attached to the connecting plates 30 at one end of the cutout 34. The tab 36 is bent or manipulated outward so as to form a receiving channel 38 for mating with the posts 20 of the bracket 12, wherein the combination of tab and plate forms a type of clip. The channel 38 created between the inside surface of the tab 36 and the inside surface of the plate 30 is slightly less than the thickness T of the support posts 20. In this way, the support posts 20 are biased against the tab 36 and the connecting plates 30 when the ground bar 22 is mounted to the bracket. This keeps the ground bar fixed on the front side of the bracket 12. After the ground bar 22 is mounted to the posts 20 of the bracket, the bus bar portion 32 of the ground bar is enabled to couple with individual circuit protection modules 44 (shown in FIG. 2). Inclusion of these circuit protection modules is desirable in order to reduce the risk of damage from electrical surges to telephone equipment coupled to the block.

As an alternative to connecting the ground bar 22 at a front side 39 of the bracket 12, the ground bar 22 may also be connected at the rear 41 of the bracket. This orientation is shown in FIG. 1 at the second receptacle slot location 42. In a similar fashion to the front mounting orientation, the identical ground bar 22 clips to the bottom of the support posts 20 through support post slots 43 in a fixed manner. In this case the support post 20 is once again biased between the tab 36 and connecting plate 30 of the ground bar. This dual orientation for the bus bar 22 enables individual circuit protection modules 44 to be mounted to either (he front or rear side of the connecting block. Accordingly, the present invention ground bar/mounting bracket combination 10 increases the flexibility of connecting arrangements which can be accomplished by an installer or service person. Although the connection of the present invention ground bar to the mounting bracket is illustrated by means of a tab and plate, it will be understood that other clip and/or force fit arrangements may also be utilized to couple the ground bar to the mounting bracket.

The mounting bracket 12 as shown is in a closed position wherein the closed bracket forms an essentially box-like, rectangular structure. The bracket 12 and ground bar 22 are made from a rigid conductive material, for example, steel or aluminum. In a preferred embodiment of the invention, the mounting bracket has a width W of approximately 4" in order to be mountable on standardized cross-bars and frameworks of the type used in electrical cabinets and utility areas. The length L of the bracket is determined by the number of terminations necessary to be accommodated, with brackets being available in many standard lengths to provide any number of terminations. In a preferred embodiment of the invention the connector modules 14 will be arranged on 0.9 inch centers, resulting in an overall length of 9 inches for a 100 pair connecting block when 10 pair connecting modules are used. Apertures 45 are included on either side of the mounting bracket to facilitate cable insertion and dressing.

Figure 2:
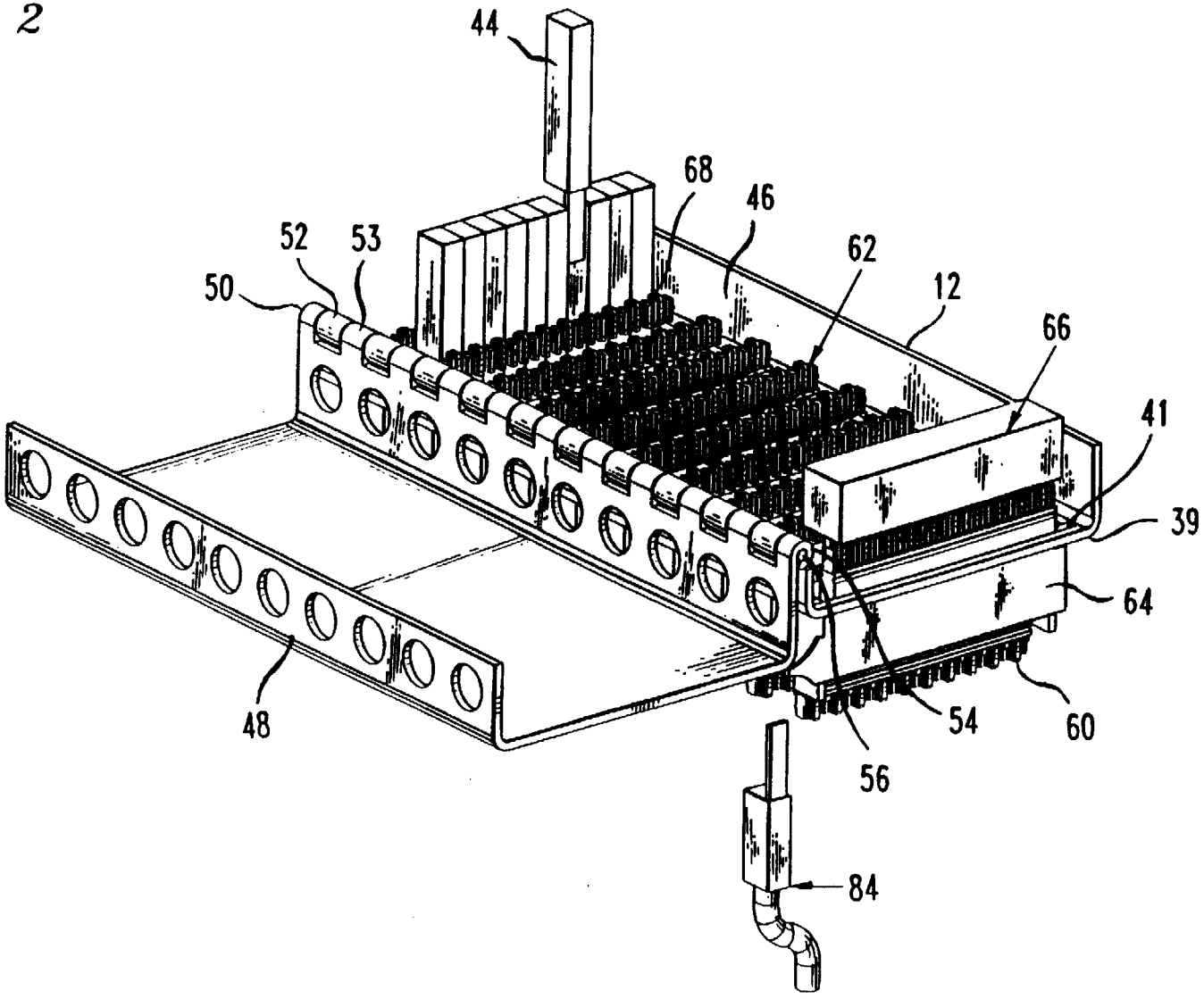
FIG. 2 shows a rear perspective view of the mounting bracket in an open position.

Referring to FIG. 2, an illustration of the present invention mounting bracket 12 is shown from the rear. FIG. 2 illustrates that the mounting bracket 12 is comprised of two separate pieces, a front receptacle piece 46 and a rear bracket base 48. The rear base 48 is coupled longitudinally along a side edge to the front receptacle piece 46 by means of a hinge mechanism 50. In the shown embodiment the hinge mechanism 50 comprises a series of interleaved edges 52, 53 which edges are curled in such a manner so as to define alternating cylindrical hollows 54 within. The hollows are adapted to receive a cylindrical pin 56 or like member in order to align the curled edges 52, 53 and join the two pieces. The front receptacle 46 (or base 48) is then capable of rotating on the hinge 50 in varying degrees from a fully open or closed position. A closure 58 (shown in FIG. 1) may be included so as to secure the front piece 46 into place when closed. Although the shown embodiment utilizes a hinge mechanism to provide pivotal movement for the front of the bracket, it will be understood that other connecting schemes, for example a form of strap connection, may also be implemented with the bracket. The front receptacle piece may also be completely removable from the base (FIG. 1), wherein the front couples to the base by means of a snap-fit or force-fit connection.

FIG. 2 shows the mounting bracket 12 to be fully stocked with connector modules 14. Sets of terminals 60,62 within the connector modules 14, for example, insulation displacement-type connector terminals, face both to the front side 39 and rear 41 of the mounting bracket. As can be seen the terminals 62 of the connector modules 14 are completely accessible from the rear when the mounting bracket is in an open position. A first connector module 64 is shown with a gas tube protector cartridge 66 mounted thereto, while a last connector module 68 is shown with a plurality of individual protectors 44 for covering single sets of connector terminals 60, 62. These protectors 44, 66 provide protection from excessive voltages or currents on the telephone wires caused by outside disturbances, such as lightning. The individual protectors 44 are utilized with the present invention ground bar 22 to provide a discharge path to the mounting bracket 12 and are coupled to the ground bar when inserted. The cartridge protectors 66, meanwhile, include an internal ground bus which provides a discharge path for all terminals on the connector module. This can be accomplished since the cartridge protector spans the entire width of receptacle slot. The ground bar of the cartridge protector as with the present invention ground bar 22, also couples to the posts 20 of the mounting bracket in order to complete a circuit path. The connector modules 14 are also adapted to receive the gas tube protector cartridges 66 and individual protectors 44 at the rear side 41 of the bracket. It will also be understood that the protector modules may include solid state (PTC), carbon-type or other like types of protection circuitry.

Figure 3B:
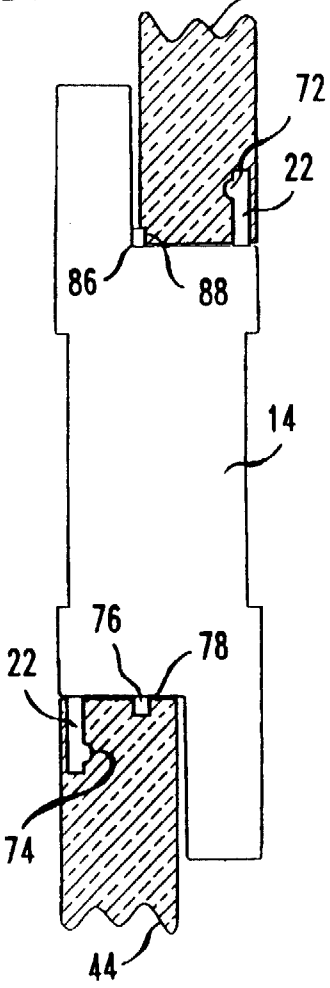
FIG. 3B shows a cross sectional view of a connector module having both circuit protection module and a test plug installed therein.
Figure 3A:
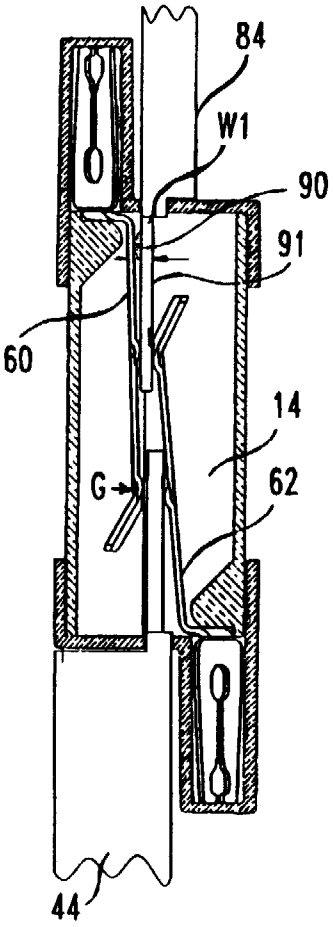
FIG. 3A shows a cross section of the circuit protection as it couples to the ground bar.
Figure 3:
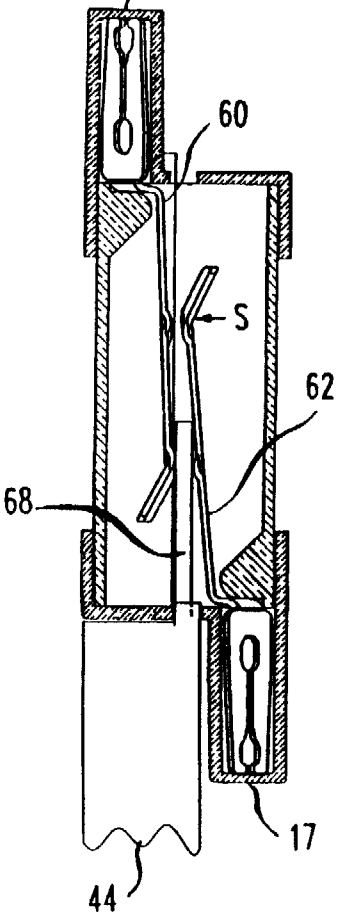
FIG. 3 shows one preferred embodiment of a connector module and protection module used in conjunction with the present invention ground bar and mounting bracket.

Referring to FIG. 3, there is shown a cross-section of one preferred embodiment of a connector module 14. The connector module is shown with terminal caps 17 located on the front and rear side terminals 60, 62, respectively. Also included on the rear side 41 of the connector module is a single terminal pair protector unit 44. The single unit protector 44 is inserted within the rear of the connector module 14, wherein a conductor 68 from the protector makes contact with both the front and rear terminals of the connector module. Insertion of the protector 44 causes a separation S between the front and back terminals 60, 62 of the protector module so that current is forced to flow through the protector 44.

Referring to FIG. 3A, a cross section of the individual protector unit 44 is shown as the unit seats within the connector module 14. As can be seen the individual protector 44 includes a cavity 72 which is adapted to receive and mate with the ground bar 22 to thereby establish an electrical discharge path for the protector. The ground bar 22 as shown is designed to fit over the connector module 14 and a positive seat (rounded protrusions) 74 on the ground bar will indicate when an individual protector is fully inserted. Individual protectors 44 and corresponding ground bars 22 are shown installed in both the front and rear of the connector 14. This is done for illustration purposes to show the flexibility of the connector module system. Practical applications would normally require only that protection to be installed at one of these locations.

FIG. 3 A also illustrates an exclusionary feature included on the connector modules to 14 to ensure proper polarity insertion of the protection modules 44, 66. A key 76 and slot 78 system is shown within the interior of an individual protector 44 which is to be installed on the rear of a connector module. Another corresponding key 86 and slot 88 is disposed at one end of an individual protector unit 44 which is to be installed in the front of a connector module 14. The exclusion feature ensures that current and voltage limiting protector units cannot be installed in the wrong orientation.

Referring to FIG. 3B a connector module is shown having an individual protector 44 installed in the rear 41 of the module 14 and a test plug 84 installed in the front side 39 of the module. A tab 90 is included in a base portion the conductor 91 of the test plug 84 having sufficient width W1, to bias apart the terminals 60, 62 of the connector module when the test plug is inserted. A gap G of predetermined width is created between the front facing terminal 60 of the connector module and the conductor 68 of the individual protector module when the test plug 84 is inserted. The rear side terminal 62 (or cable termination side) remains coupled to the protector unit 44. This demonstrates the ability to test bi-directionally utilizing the test plug feature, while at the same time maintaining circuit protection on the rear or cable termination side of the connector block.

The hinged mounting bracket and ground bar combination 10 provides a significant advantage over the prior art in that the rear of the connector modules 14 which make up the connector block 16 is easily accessible when the front receptacle piece 46 is in the open position. As will be understood, the mounting bracket is mounted at a telephone office or other premises by means of the bracket base. The base 48, as shown in FIG. 1 includes a series of apertures 92 in various dimensions comprising a universal mounting arrangement which enable the bracket to attach to a main distributing frame (MDF) on the horizontal or vertical side and to various cross-bars, frameworks and other mounting surfaces.

Cable terminations can then be made on the rear of the connector block 16, wherein the terminations are easily accessed, even after the bracket has been mounted, by swinging open the front portion 46 of the bracket to cause rotation about the hinge 50. Voltage and current protection in the form of the gas tube protectors 44, 66 used in conjunction with the ground bar 22 are also easily mountable in the rear of the connector block. By implementing the cable terminations and the circuit protection at the rear of the connector block 16, terminals 60 on the front 39 of the connector block 16 remain free for cross-connections and to allow access for any testing procedures that need be performed. Testing of any of the connections is further facilitated in that the connector modules 14 are adapted to receive a test plug 84 at the front or rear of the of the modules to perform testing on each of the terminals 60, 62, both in an out of circuit, without removal of the circuit protection or terminations.

From the above, it should be understood that the embodiments described, in regard to the drawings, are merely exemplary and that a person skilled in the art may make variations and modifications to the shown embodiments without departing from the spirit and scope of the invention. All such variations and modifications are intended to be included within the scope of the invention as defined in the appended claims.

What is claimed is:

1. In a modular connecting block system for termination of wires, wherein connector modules having a plurality of terminals facing a front and rear side thereof are insertable within a mounting bracket for mounting of said connecting block, said bracket including a plurality of support posts aligned on either side of said bracket for retaining said connector modules, a ground bar apparatus for attachment to said bracket, said ground bar apparatus comprising:

a unitary metallic strip formed into three distinct sections including, first and third sections including fastening means for fastening to said support posts of said bracket to thereby electrically couple said ground bar to said bracket, and a second section perpendicularly coupled between said first and third sections, said second section including a ground bus adapted to electrically couple with circuit protection modules installable in a front and rear side of said connector modules, wherein said fastening means of said first and third sections is adapted to couple to front facing and rear facing ends of said support posts of said bracket.

2. The system of claim 1, wherein said fastening means comprises a clip for attachment of said ground bar to said support posts.

3. The system of claim 2, wherein first and third sections comprise generally flat thin members each having a cutout disposed therein, wherein material from said cutout remains attached at one end to said members and is bent outward to form a tab, and wherein said tab is adapted to slide over said support posts of said bracket for attachment thereto.

4. The system of claim 3, wherein said tab is adapted to bias against said support posts in order to create a force fit.

5. The system of claim 1, wherein said ground bus includes a rounded protrusion extending longitudinally along one edge thereof, wherein a positive seat is established for coupling of said circuit protection modules thereto.

6. The system of claim 2, further including said mounting bracket having said support posts extending vertically upward therefrom, wherein said support posts each include a slot at a base portion thereof where said posts couple to said bracket, said slot being adapted to receive therethrough a portion of said clip from said fastening means to thereby enable attachment of said ground bar on a rear side of said bracket.

7. The system of claim 6, wherein said mounting bracket includes a front and back plate couplable to one another, wherein said front plate is openable to gain access to said rear facing side of said connector modules and said ground bar apparatus when said ground bar is mounted in the rear of said bracket.

8. The system of claim 6, wherein said ground bar and mounting bracket are comprised of a rigid conductive material.

9. The system of claim 6, wherein said front plate includes a row of generally rectangular slots disposed adjacent said support posts, wherein a single slot and pair of said support posts on either side of said plate define a receptacle area for insertion of a single one of said connector modules.

10. The system of claim 7, wherein said front and back plates are coupled by means of a hinge mechanism.

11. A combination mounting bracket and ground bar apparatus for use with modular connectors for termination of wires, said modular connectors having terminals on a front and rear facing side thereof for accepting said wires and said connectors being adapted to receive circuit protection modules for protecting equipment coupled to said telephone circuits, said combination comprising:

a mounting bracket including a plurality of receptacle areas for receiving said modular connectors, said receptacle areas each including a pair of outwardly projecting support posts adapted to retain said connectors, and a grounding bar attachable to said support posts of said mounting bracket, said grounding bar including fastening means adapted to attach to a front facing and rear facing side of said bracket, wherein said grounding bar upon attachment is oriented proximate said connector modules, whereby said circuit protection modules couple to said ground bar to establish a discharge path therefor.

12. The combination of claim 11, wherein said ground bar includes first and second sections including said fastening means to electrically couple said ground bar to said bracket, and a third section perpendicularly coupled between said first and second sections, said third section including a ground bus adapted to electrically couple with said circuit protection modules.

13. The combination of claim 12, wherein first and second sections comprise generally flat thin members each having a cutout disposed therein, wherein material from said cutout remains attached at one end to said members and is bent outward to form a tab, and wherein said tab is adapted to slide over said support posts of said bracket for attachment thereto.

14. The combination of claim 13, wherein said tab is adapted to bias against said support posts in order to create a force fit.

15. The combination of claim 11, wherein said ground bar includes a rounded protrusion extending longitudinally along one edge thereof, wherein a positive seat is established for coupling of said circuit protection modules thereto.

16. The combination of claim 13, wherein said support posts each include a slot at a base portion thereof, said slot being adapted to receive said tab to thereby enable attachment of said ground bar on a rear side of said bracket.

17. The combination of claim 11, wherein said mounting bracket includes a front and back plate removably attached to one another, wherein said front plate is openable to gain access to said rear facing side of said connector modules and said ground bar apparatus when said ground bar is mounted in the rear of said bracket.

18. The combination of claim 11, wherein said ground bar and mounting bracket are comprised of a rigid conductive material and said ground bar comprise a unitary strip of said material.

19. The combination of claim 17, wherein said front plate includes a row of generally rectangular slots disposed between adjacent support posts, wherein a single slot and pair of said support posts on either side of said plate define said receptacle area for insertion of a single one of said connector modules.

20. The combination of claim 17, wherein said front and back plates are coupled by means of a hinge mechanism.

21. The combination of claim 17, wherein said front and back plates couple together in a snap-fit arrangement.

22. The system of claim 7, including a force-fit coupling arrangement between said front and back plates, wherein said front plate snaps onto said back plate, said front plate being removable.

* * * * *